United States Patent [19]

Horie et al.

[11] Patent Number: 4,653,896

[45] Date of Patent: Mar. 31, 1987

[54] PROCESS FOR DEVELOPING AND TRANSFERRING MAGNETIC TONER IMAGES

[75] Inventors: Kiyoshi Horie; Tsuneo Noami; Koji Masuda; Koichi Saitoh; Kazuo Maruyama; Yoshihiko Fujimura; Yuji Suemitsu; Toshiro Yamamoto, all of Kanagawa, Japan

[73] Assignee: Fuji Xerox Co., Ltd., Tokyo, Japan

[21] Appl. No.: 485,074

[22] Filed: Apr. 14, 1983

[30] Foreign Application Priority Data

Apr. 15, 1982 [JP] Japan ..... 57-61675
Jul. 26, 1982 [JP] Japan ..... 57-129023

[51] Int. Cl.[4] ..... G03G 13/09; G03G 15; G03G 09

[52] U.S. Cl. ..... 355/3 DD; 355/14 D; 430/122

[58] Field of Search ..... 355/3 R, 3 DD, 14 D, 355/3 TR; 430/120, 122; 118/657, 658

[56] References Cited

U.S. PATENT DOCUMENTS

| | | | |
|---|---|---|---|
| 4,166,691 | 9/1979 | Ebi et al. | 355/3 DD X |
| 4,190,348 | 2/1980 | Friday | 355/3 TR |
| 4,194,828 | 3/1980 | Holz et al. | 355/3 DD |
| 4,292,387 | 9/1981 | Kanbe et al. | 355/3 DD X |
| 4,350,440 | 9/1982 | Watanabe | 355/3 DD |
| 4,382,420 | 5/1983 | Ohnuma et al. | 355/3 DD X |
| 4,422,749 | 12/1983 | Hoshino et al. | 355/3 DD |

*Primary Examiner*—Fred L. Braun
*Attorney, Agent, or Firm*—Sughrue, Mion, Zinn, Macpeak & Seas

[57] ABSTRACT

In electrostatic latent image developing process capable of effecting either positive or negative reproduction a magnetic toner of a high resistivity is controlled to form a magnetic brush having a potential insufficient for development. The toner chain constituting the brush is separated under the influence of an electric field between the developing roll and the image carrier, to produce toner particles having one polarity continuing with the developing roll, and particles of the opposite polarity transferred to the carrier.

21 Claims, 12 Drawing Figures

PROCESS FOR DEVELOPING AND TRANSFERRING MAGNETIC TONER IMAGES

BACKGROUND OF THE INVENTION

This invention concerns a magnetic brush developing process for electrostatic latent images and, more specifically, it relates to a magnetic brush developing process for electrostatic latent images using highly resistive magnetic toner.

Various processes have been known for developing electrostatic latent images in electrophotography, electrostatic recording, electrostatic printing or the like. These developing processes can generally be classified into liquid developing processes and dry developing processes.

The dry developing processes include the two-component developing process employing toner composed of a binder resin and a coloring agent such as carbon black dispersed therein and carriers such as glass beads, and the one-component developing process employing only toner without using carriers. This invention concerns the one-component developing process employing only toner.

In the one-component developing process, various methods such as the fur brush method, the touch-down method and the power cloud method have been known, and many proposals have been recently made for development using magnetic brushes formed by the use of magnetic toner composed of binder resins and ferromagnetic materials dispersed therein. One-component developing processes using magnetic toner can generally be classified depending upon the electric resistance of the toners employed, i.e.:

(1) less resistive toner
(2) highly resistive magnetic toner, and
(3) insulative magnetic toner.

The developing process employing the less resistive magnetic toner uses comparatively conductive or semiconductive magnetic toner of an electric resistance up to $10^8$ Ω.cm, and performs development by way of an electrostatic induction method, the details of which are described, for instance, in Japanese Patent Laid-Open No. 4532/1974. While the process can perform development by merely contacting or bringing a magnetic brush of less resistive magnetic toner close to the electrostatic latent images, it involves a problem in that the toner images scatter upon electrostatic transfer thereof onto transfer paper by way of corona transfer, bias transfer or the like. Accordingly, image formation has to be carried out, after the formation of toner images on the photosensitive paper, through direct fixing with no transfer step, or by transfer and fixing on a special transfer paper which is resin-processed and highly electrically insulating.

To overcome the problems in transfer performance, a developing process has been attempted using highly resistive magnetic toner of an electrical resistance between $10^9$–$10^{16}$ Ω.cm, or insulating magnetic toner of an electrical resistance higher than $10^{17}$ Ω.cm respectively. Although the transfer performance can be improved with an increase in the electric resistance of the toner and corona transfer is made possible without special transfer paper, particularly with respect to the insulative magnetic toner, the process has a defect in that it degrades the developing performance.

In the developing process employing highly resistive magnetic toner or insulative toner respectively, it is impossible to charge the toner by way of the electrostatic induction method as employed for the less resistive magnetic toner, and it is required to charge the toners by some additional means. Such toner charging methods include friction charging between toner particles or between toner particles and an external frictional charging means (for example, see Japanese Patent Laid-Open Nos. 62638/1975, 26046/1976, 22745/1978, 30339/1978 and 106036/1978), corona charging of the toner (for example, see Japanese Patent Laid-Open Nos. 91742/1978 and 68247/1979), or charge injection to the toner by electrodes (for example, see Japanese Patent Laid-Open Nos. 117432/1975 and 51842/1979), and further polarizing development by the dispersion of highly dielectric material in the toners (for example, see Japanese Patent Laid-Open No. 97742/1977). However, the frictional charging method, although capable or providing satisfactory development to some extent at the initial stage, is not satisfactory in that changes with aging are caused in the charging amount, due to the contamination or denaturing such as the surface oxidation of the charging material, or the charging amount is varied by circumstantial changes such as humidity to degrade developing performance.

In the corona charging method, the charging amount is changed by the contamination of the corotron with toner and the toner is deposited on non-image areas as well due to the large charge imparted by the corotron.

The charge injection method using electrodes has defects in that the charging efficiency is poor, making it difficult to obtain the required amount of charge or, if the required amount could be obtained, the amount of injected charge is varied even with minute scratches on the electrodes, which will be reflected as stripes in the picture images. Further, abnormal discharging is caused by electroconductive impurities.

The polarizing method has a defect in that toner capable of attaining satisfactory polarization cannot be obtained with ease and in that electric charge must be applied previously to the toner upon transfer.

As stated above, the conventional developing method using insulating toner, although capable of satisfying transfer performance to some extent, cannot prevent the degradation in the developing performance, particularly, due to aging or circumstantial changes. The developing process using highly resistive magnetic toner, although capable of somewhat stabilized development, also unsatisfactory in that it exhibits poor transfer performance (particularly in highly humid conditions) and results in the scattering of toner images and a reduction of the transfer efficiency. Thus, the conventional developing processes using insulative magnetic toners or highly resistive magnetic toners, respectively, cannot render developing performance and transfer performance compatible with each other.

This invention further concerns a process for transferring reversed magnetic toner images. The one-component developing process conventionally carries out development by applying a desired polarity to the magnetic toner by means of an external means such as charge injection or corona charging and has advantages in that it is capable of performing reversed development with ease by the selection of the polarity. A novel reversed development process, where magnetic toner is deposited on the portion corresponding to the white area on a negative image original, can take place by forming electrostatic latent images on a photosensitive material by the use of the negative-image original, applying electric charges with a polarity identical to that of the latent images to the magnetic toner, and conducting development while keeping the developing bias at a potential approximately equal to the potential at the non-exposed area. However, it has been discovered that, upon corona transfer of the toner images subjected to the reversed development, fogging results,the transfer efficiency is poor, reducing the image density, or the toner images are scattered even by the use of magnetic toners of high electrical resistance. That is, although satisfactory corona transfer can be attained for normally developed toner images obtained by the use of a positive image original, such undesired phenomena may result from the corona transfer of the toner images developed in the reversed manner using the same magnetic toner.

SUMMARY OF THE INVENTION

Accordingly, the object of this invention is to provide a developing process capable of rendering the developing performance and the transfer performance compatible with each other in the conventional one-component magnetic developing process, with no changes in developing performance being caused due to aging or circumstantial changes.

In order to overcome the defects of the conventional one-component magnetic developing processes, the present inventors have made a study with respect to highly resistive magnetic toner, particularly, highly resistive magnetic toner in a $10^{12}$–$10^{16}$ Ω.cm resistance region and, as a result, have discovered a novel magnetic brush developing process capable of rendering developing performance and transfer performance compatible with each other.

The characteristic features of this invention reside in using highly resistive magnetic toner of an electric resistance between $10^{12}$–$10^{16}$ Ω.cm, disconnecting a magnetic brush formed with the highly resistive magnetic toner to separate the toner chain in an electric field formed by electrostatic latent images and a developing roll, to thereby produce electric charges in the direction opposite to the above electric field with polarities opposite to each other in the toner on the side of the electrostatic latent image and in the toner on the side of the developing roll, respectively, developing the electrostatic latent images with the toner having the thus produced electric charges, maintaining a smaller distance between the carrier for electrostatic latent images and the developing roll and further maintaining the developing potential at the background area, prior to development, lower than the potential upon the start of development, so that it is insufficient for development as it is.

It is also an object of this invention to provide a transfer process with no fogging, at a satisfactory transfer efficiency and with no toner scattering upon the transfer of reversed magnetic toner images onto a transfer material such as paper.

The transfer process according to this aspect of the invention is characterized by carrying out the transfer while maintaining the latent image potential of the electrostatic latent image carrier at a certain potential at the completion of the development upon transfer, and utilizing AC corona transfer.

DETAILED DESCRIPTION OF THE PREFERRED EMBODIMENTS

For an explanation of this invention, reference is first made to the principle of producing electric charges due to the separation of a magnetic brush under an electric field (hereinafter referred to as separation charging).

Figure 1:
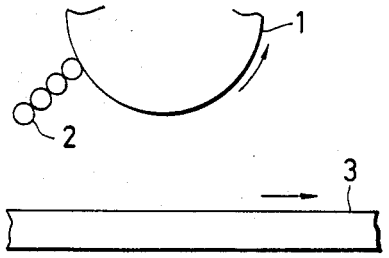
FIGS. 1(*a*)–1(*d*) are explanatory views for explaining the principle of separation charging development according to this invention.
Figure 1:
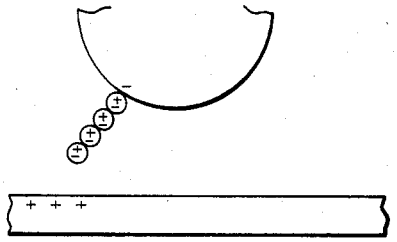
Figure 1:
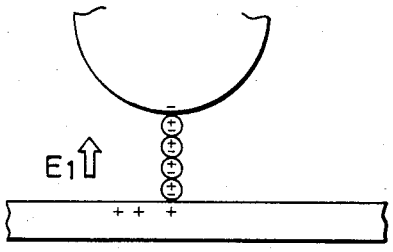
Figure 1:
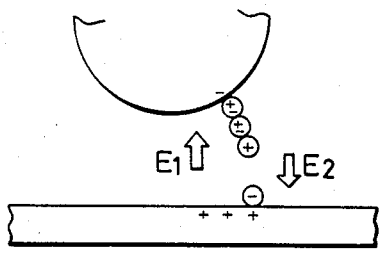

FIG. 1(*a*)–1(*d*) schematically show the principle of separation charging according to this invention, in which are shown a developing roll 1, highly resistive magnetic toner 2 and electrostatic latent image carrier 3. FIG. 1(*a*) shows the toner chain in the state before it is placed under the effect of an electric field formed between the carrier 3 and the developing roll. The magnetic toner particles 2 in this state have an insufficient amount of electric charge to develop the latent images, in which the potential of the toner layer is low and the developing potential at the background area is maintained lower than the potential upon the start of the development.

Then, as the magnetic toner 2 is placed under the effect of the electric field formed between the carrier 3 and the developing roll 1 with the movement of the developing roll 1 and the carrier 3 (refer to FIG. 1(*b*)), electric charges are produced on the magnetic toner particles 2. It is assumed that the electric charges are, probably, produced by the polarization or induction of the magnetic toner particles, since the same phenomenon also results in the case where the surface of the developing roll is supplied with an insulating cover. When the magnetic toner particles in such a state contact the latent image carrier (FIG. 1(*c*)) and separation begins between the toner particles, electric charges with opposite polarities are produced in the toner on the latent image carrier and in the toner remaining on the developing roll, respectively, among the toner particles thus separated (FIG. 1(*d*)).

This may be attributable, it is considered, to the fact that electric charges of opposite polarities present at the contacting faces are exchanged between the toner particles and electric charges of opposite polarities are produced in the toner by the separation.

In this case, electric charges are produced between the toner particles in such a manner that an electric field $E_2$ is produced opposite to the direction of the electric field $E_1$ between the latent image carrier and the developing roll and, as a result, electric charges of a polarity opposite to that of the electrostatic latent images, that is, negative charges, are produced in the toner at the latent image carrier and electric charges of a polarity identical to that of the electrostatic latent images, that is, positive charges, are produced in the toner at the developing roll, resepctively. The magnetic toner having the thus produced electric charges has a sufficient amount of charge for development, as a result, toner having an electric charge of a polarity opposite to that of the electrostatic latent images is deposited in the image area of the electrostatic latent images to carry out development.

In order to enable separation charging as described above and render the developing performance and the transfer performance compatible with each other, highly resistive magnetic toner having an electric resistance between $10^{12}$–$10^{16}$ Ω.cm is used. Magnetic toners in such a range are situated at the higher resistance end of known highly resistive magnetic toners, and the resistance can generally be adjusted based on the amount of magnetic material dispersed in the toner, while this varies depending on the manufacturing conditions and materials employed in the toner.

The electrical resistance referred to here is determined by placing a toner block of about 3 mm thickness, which is compression-molded under a pressure of 500 kg/cm$^2$, between electrode plates and measuring the relation between the voltage and the current under an electric field of 8 Kv/cm$^2$ applied thereto.

If the resistance measurement is carried out in the normal powderous state or in a compressed state under a lower pressure of about 1 Kg/cm$^2$ as has been previously known, the ohmic contact between the toner is great and, particularly, upon measuring magnetic toner with high electrical resistance, the measured value thus obtained will always indicate the same level of resistivity even for different toners, which cannot be taken as the true electric resistance value for the toners. The resistance value for highly resistive magnetic toners can be determined as above by measuring after compression-molding and under a high electric field. Highly resistive toners have usually been referred to as such based on the value obtained by measuring them in the powder state. By the measuring method according to this invention where the toner is compression-molded, resistance values lower by about 3 orders of magnitude are generally obtained. It has hitherto been considered difficult to render the developing performance and the transfer performance compatible with respect to highly resistive magnetic toners of a resistance value between $10^9$–$10^{16}$ Ω.cm measured in this way. Specifically, the developing performance is inferior to that of the less resistive magnetic toners of less than $10^8$ Ω.cm and the transfer performance is inferior to that of insulating toner higher than $10^{17}$ Ω.cm. However, the developing performance and the transfer performance can be rendered compatible by using magnetic toners of $10^{12}$–$10^{16}$ Ωcm, higher in resistance than the usual highly resistive magnetic toners, and by developing through separation charging. This is attributable, it is considered, to the fact that the amount of electric charge polarized or induced under the effect of the electric field and the charge retention time of the magnetic toner can preferably be controlled upon development through separation charging by using magnetic toners of $10^{12}$–$10^{16}$ Ω.cm. In the case of using magnetic toners of a resistance lower than $10^{12}$ Ω.cm, image density is decreased due to the reduction in the transfer efficiency, or toner images may scatter during the corona transfer, particularly, during the transfer step. In the case of using magnetic toners of a resistance value higher than $10^{16}$ Ω.cm, the magnetic toner acquires a great amount of electric charge due to frictional charging prior to development. That toner having a great amount of electric charge and easily developed is used at first for development during the repetitive use of the magnetic toner in the developing device, to result in the phenomenon of gradual reduction in the image density or gradation.

In the developing process according to this invention, the developing potential at the background area is maintained lower, prior to development, than the potential upon the start of development.

The mentioned developing potential at the background area indicates the absolute value of the difference between the potential at that portion corresponding to the background area of the latent image carrier, and the potential of the toner layer on the developing roll. The "toner layer potential" indicates the potential including a developing bias voltage in case development is carried out while applying a developing bias voltage to the developing roll.

The potential upon the start of development indicates the developing potential at the background area when the toner starts to deposit onto the background area of the latent image carrier. While varying depending on the kind of the carrier, the charged potential and the magnetic toner employed, the potential upon the start of development is about 200 V in absolute value and the developing potential at the background area is set to less than about 200 V (absolute value) in this invention.

Since the potential at the background area of the latent image carrier is generally determined by the latent image carrier, it is preferred to control the potential of the toner layer on the developing roll in order to maintain the developing potential at the background area lower than the potential upon the start of development. To lower the developing potential at the background area to less than the potential upon the start of the development by the control of the toner layer potential, a stable potential can be obtained for the toner layer even with the repetitive use of the toner by (1) making the charge amount of the magnetic toner lower, (2) making the erection density of a magnetic brush lower or (3) injecting electric charges of a polarity opposite to that of the toner charges by using electrodes to thereby control the potential of the toner layer prior to development. Further, in order to maintain the lower toner layer potential and to control it uniformly both in the axial and circumferential directions of the developing roll, it is preferred to select, among the above, one of the methods (1) and (2). Further the charge amount of magnetic toner that lowers the developing potential at the background area to less than the potential upon the start of development is less than about 1 μC/g. The electric charge of the toner, which may be either positive or negative, is controlled to less than about 1 μC/g in absolute value.

The "charge amount" of the toner as referred to herein does not indicate the total charge on the toner particles on the developing roll but rather the charge of individual toner particles, that is, the charge on individual magnetic toner particles is controlled to less than about 1 μC/g. In order to maintain the toner charge in this way, it is preferred to contact the magnetic toner on the developing roll with a charge eliminating member prior to development, to thereby release excess charge on the toner, or to use those magnetic toner particles having surface electroconductive portions, for example, magnetic toner having magnetic materials partially exposed on the particle surface or magnetic toner having fine electroconductive particles such as carbon black deposited on the particle surface, so that no excess electric charges are supplied by frictional charging due to friction between the magnetic toner particles themselves or between the magnetic toner and the developing roll.

The erection density of the magnetic brush can be lowered by setting an appropriate value for the ratio of the distance between the erection control plate and the developing roll (TG) relative to the distance of the developing roll and the latent image carrier at the narrowest point (DRS). For lowering the developing potential at the background area to less than the potential upon the start of development, TG/DRS is set between 0.4–0.8.

By maintaining the developing potential at the background area lower than the potential upon the start of development, it is possible to eliminate fogging in development, to keep the amount of charge produced in the magnetic toner uniform and constant upon successive separation charging operations, and attain stable development with no effect due to aging or circumstantial changes.

If the potential of the toner layer on the developing roll before development is maintained lower as stated above, the required amount of charge for development may possibly not be produced even upon separation charging. In view of the above, it is required to minimize the distance between the roll and the latent image carrier at the narrowest point (DRS) so as to substantially increase the electric field, to thereby increase the amount of charge produced by the polarization or induction of the toner particles when placed under the influence of the electric field.

Although smaller distances are better, it is preferred to set DRS between 0.1–1.0 mm and, preferably, 0.2–0.7 mm, considering the fabrication accuracy of the roll or the like and maintenance.

The electric charge required for development is produced by separating the magnetic brush formed between the toner particles under the effect of the electric field. The separation has to be made midway of the toner chain of the magnetic brush, and this is determined by the relationship between the relative moving speed of the magnetic brush and the latent image carrier, as well as by the erection density of the magnetic brush (TG/DRS). Further, disturbance in the picture images can be prevented by separating the toner chain at a position 5 layers from the top end of the toner chain. Such separation between the toner particles can be attained by increasing the surface moving speed of the magnetic brush to three times the surface moving speed of the latent image carrier. If the ratio between the moving speeds is less than three, the magnetic brush cannot be disconnected, resulting in disturbed images. It is also possible to attain development with increased image density by rendering the moving speed ratio greater than three. Further, TG/DRS is set to 0.4–0.8 in the same manner as described above.

It is required to enable charge exchange between the toner particles to be separated upon production of electric charges in development and this can, preferably, be attained as described above by using those magnetic toners having electroconductive surface portions such as magnetic materials partially exposed on the particle surface or fine electroconductive particles such as carbon black deposited on the particle surface. At least one layer of carbon black may be deposited on the surface of the toner particles in the case of carbon black deposition, or carbon black may be embedded so as to be exposed at the surface of the toner particles.

The various one-component developing processes employed thus far with the aim of improving developing performance are adapted to carry out development by applying the required amount of electric charge to the magnetic toner prior to development, and this results in the degradation of developing performance due to the instability of charging and aging or circumstantial changes. This invention is, however, adapted to carry out development by producing the required amount of electric charge for development only for that magnetic toner in contact with the portion of the latent images to be developed, depending on the electric field formed with the electrostatic latent images upon development, whereby no degradation results in developing performance.

The developing roll for use in this invention is composed of a non-magnetic sleeve having a conductive surface and a magnet disposed therein, and at least the non-magnetic sleeve is made rotatable. By using the rotatable non-magnetic sleeve, it is possible to move the magnetic brush at a high speed with a moving speed ratio greater than three as described above. The amount of magnetic toner fed can be increased and high density development performed. It is not desired to make the surface of the non-magnetic sleeve insulative, since the charge amount of the toner will increase during repeated development to provide the toner layer with a sufficient potential for development to thereby result in reverse development and fogging phenomena. It is thus preferred to render the surface of the non-magnetic sleeve electroconductive. The magnets disposed inside the sleeve are provided in the vicinity of the sleeve and are disposed so as to present different polarities alternately. Thus, magnetic poles comprising N poles and S poles are successively arranged alternately, or magnetic poles in which a portion of the magnetic poles adjacent to each other are made to have the same polarity are provided and N poles and S poles are successively arranged in the other portions alternately. Further, the magnets may be disposed rotatably and rotated in the direction causing the movement of the magnetic toner, that is, in the direction opposite to that of the non-magnetic sleeve.

A brush erection height control plate is disposed near the developing roll in order to make the amount of the magnetic toner uniform over the developing roll. The erection control plate may be made of a conductive material and also used as a charge eliminating member in order to prevent excess charge due to frictional charging.

The magnetic toners used in this invention comprise a binder resin and a ferromagnetic material as essential ingredients and have an electric resistance of between $10^{12}$–$10^{16}$ Ω.cm.

As the binder resin, those previously employed can be used, and these include, for instance, polystyrene, styrene-acrylic copolymer, polyester, epoxy resins, and polyvinyl chloride. The ferromagnetic materials include, for instance, ferrite, magnetite, iron, nickel and cobalt, and those having an average particle size between about 0.1–1μ are preferred.

As coloring agents, carbon black, Nigrosine dye, aniline blue, calcoyl blue, chrome yellow, ultramarine blue, DuPont oil red, quinoline yellow and the like may be incorporated for use, but may not necessarily be used in the case where the ferromagnetic materials themselves act as the coloring agent. Although various additives, for example, metal salts of fatty acids and grinding agents may be admixed for use in the toner or the toner particles, the use of additives such as highly dielectric materials which may cause previous internal polarization should be avoided since this results in difficulties in transfer.

The amount of the ferroelectric material in the toner is set within such a range as renders the electric resistance of the toner between $10^{12}$–$10^{16}$ Ω.cm. While the amount vaires depending on the manufacturing conditions of the toner, the type of ferromagnetic material or the like, the amount is set to about 40–70% by weight and, preferably, 50–60% by weight of the toner.

In order to prevent the toner particles from excessive electric charge buildup and to facilitate the charge exchange upon development, electroconductive portions are partially present on the surface of the toner as described above. Such toner can be prepared by various known methods such as the spray-dry method and the melt-kneading method. Those toners having an average particle size between about 8–40μ are preferably used.

The electrostatic latent image carrier for use in this invention includes, for instance, those electrophotographic photosensitive materials having photoconductive layers such as of selenium, ZnO, CdS and organic photosensitive materials, as well as electrostatic recording materials having dielectric layers, and are used after being formed with electrostatic latent images thereon through charging and imagewise exposure, or imagewise charging by stylus electrodes.

The developed images are transferred onto a transfer material such as paper or plastic. The transfer may be carried out by way of corona transfer, conductive roll transfer or pressure transfer.

The non-fixed toner images thus transferred are fixed by means of any known method such as heat roll fixing, oven fixing, flash method or press fixing.

Figure 2:
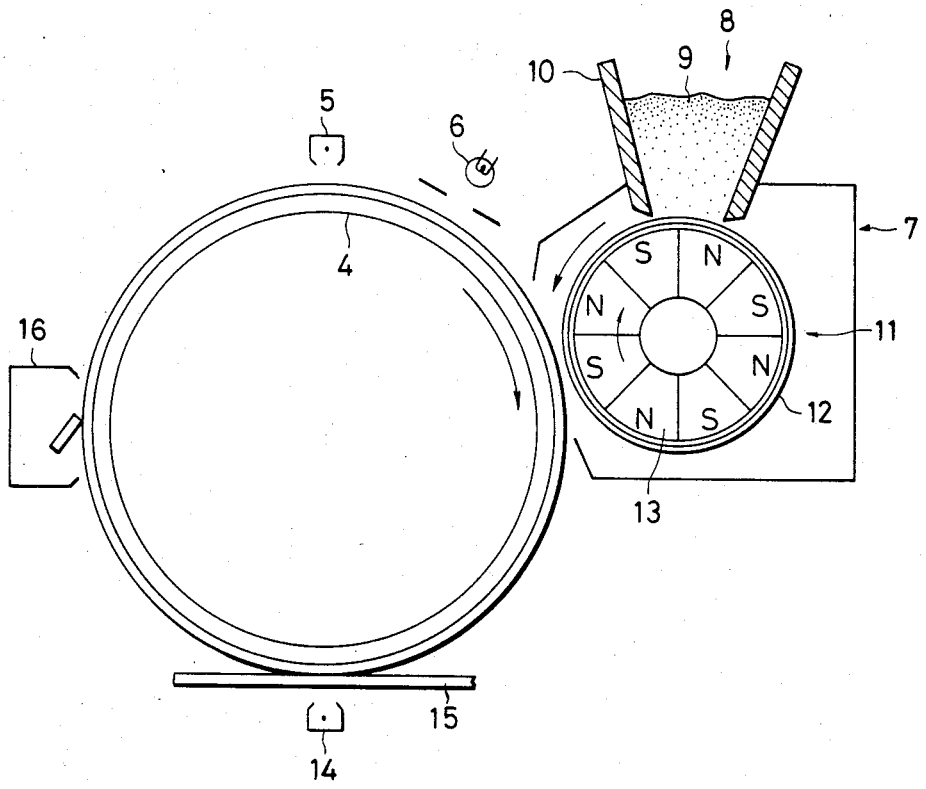
FIG. 2 is a schematic cross sectional view of one embodiment of the apparatus employed in practicing the developing process according to this invention.
Figure 3A:
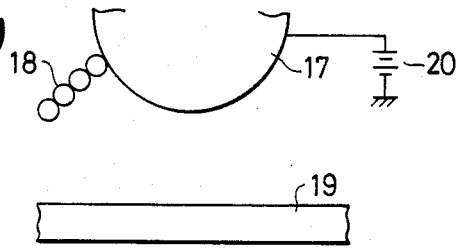
FIGS. 3(*a*)–3(*d*) are explanatory views for explaining the principle of reversed development using separation charging development according to this invention.
Figure 3B:
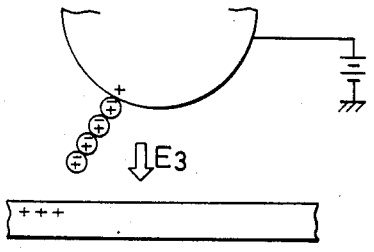
Figure 3C:
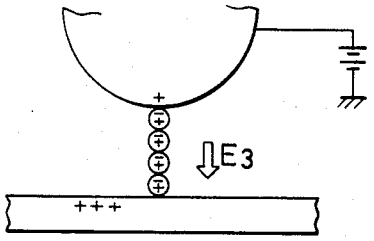
Figure 3D:
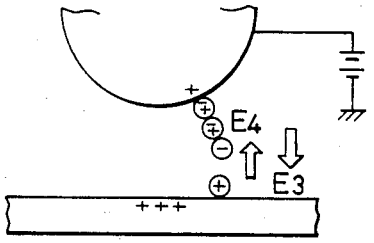

This invention will now be explained referring to an actual application example. FIG. 2 shows one example of an apparatus applying the magnetic brush developing process according to this invention, in which there are shown a developing device 7, a magnetic toner container 8, magnetic toner 9, a brush height control plate 10 forming the side wall of the magnetic toner container, a developing roll 11, and a non-magnetic sleeve 12 and magnets 13 constituting the developing roll 11.

An electrophotographic photosensitive material 4 having a photosensitive layer is formed with electrostatic latent images by a corona charger 5 and an exposing device 6. The magnetic toner 9 in the magnetic toner container 8 is transported to the developing region along with the rotation of the non-magnetic sleeve 12 and the magnets 13.

The device is adapted such that non-magnetic sleeve 12 rotates in the same direction as the photosensitive material 4 and such that the magnet 13 rotates in the direction opposite to that of the non-magnetic sleeve 12, respectively, but alternatively only the non-magnetic sleeve 21 may be rotated. The magnetic toner may be moved in either the same or opposite direction to that of the photosensitive material. The non-magnetic sleeve 12 is a cylindrical member made of aluminum, stainless steel or the like with its surface being rendered electroconductive. A thin film such as aluminum oxide may be formed to such an extent as not impairing the electroconductivity. The control plate 10 is made of a conductive material such as aluminum or stainless steel, and the control plate 10 also serves as a charge eliminating member for not providing the magnetic toner with the required amount of electric charge for development. Alternatively, an additional member may be disposed in the magnetic toner container 8 or in the vicinity of the non-magentic sleeve 12. The magnetic toner 9 employed comprises a styrene-acrylic copolymer and a ferromagnetic material dispersed therein to 55% by weight, based on the weight of the toner, and has an electric resistance of $10^{15}$ Ω.cm. The magnetic toner has no ferromagnetic material exposed on the particle surface, but has carbon black deposited on the surface thereof in a single layer. The magnetic toner 9 is conveyed from the magnetic toner container 8 along with the rotation of the non-magnetic sleeve 12 and the magnets 13 and is in contact with the height control plate 10 (also serving as a charge eliminator), whereby the amount of toner is kept constant, and a magnetic brush is formed with the toner layer potential being maintained lower than 1 ΩC/g (absolute value), so that the developing potential at the background area is lower than the potential upon the start of development.

As the magnetic brush at the lower toner layer potential insufficient for development is further moved and placed under the effect of the electric field formed between the phototsensitive material 4 and the non-magnetic sleeve 12, electric charges are produced in the magnetic toner particles of the magnetic brush. The speed of rotation is such that the moving speed of the magnetic brush is greater by a factor of about five than the moving speed of the photosensitive material. The narrowest portion between the non-magnetic sleeve 12 and the photosensitive material 4 is 0.5 mm. When the magnetic brush is in contact with the photosensitive material and the magnetic brush is separated between the toner particles, charge exchange is effected between the toner particles at the separated portion, whereby electric charges with polarities opposite to each other are produced in the toner on the photosensitive material 4 and in the toner on the non-magnetic sleeve 12, respectively.

The photosensitive material 4 is made of a Se-type photosensitive material, and, when positive electrostatic latent images are formed on the photosensitive material 4, negative charges are produced in the toner on the photosensitive material 4 and positive charges are produced in the toner on the non-magentic sleeve 12, respectively, so that an electric field is formed in the direction opposite to that of the electric field formed between the photosensitive material 4 and the non-magnetic sleeve 12. As a result, deposition results due to the electrostatic attractive force between the electrostatic latent images and the toner, to perform development.

The magnetic toner having passed the developing region and remaining on the non-magnetic sleeve 12 has an electric charge (positive charges in this case), and the amount of the electric charge is sufficient for development. The remaining toner comes into contact with the magnetic toner in the toner container 8, further, is subjected to a charge eliminating effect by the control plate 10, used for forming a new magnetic brush at a low toner layer potential insufficient for development, and is thus prepared for the next development process. On the other hand, the toner images on the photosensitive material 4 are transferred by a corotron 14 onto a transfer paper 15 and are fixed to form the reproduction product. The photosensitive material 4 after transfer is cleaned of the non-transferred toner by a cleaning device 16, is cleared of electric charge, and thus prepared for the next reproduction.

As stated above, the magnetic brush developing process according to this invention comprises forming a magnetic brush having a toner layer potential insufficient for development prior to development, maintaining the developing potential at the background area lower than the potential upon the start of development and producing electric charge of an amount and polarity required for development in the toner through separation charging in an electric field to thereby perform development, whereby, differently from conventional developing process adapted to supply the required amount of electric charge for development prior to the development, it is possible to perform development with high image density, less fogging and excellent gradation and resolution power. The invention enables a developing process where development at a high quality is not changed even with aging or circumstantial changes. Also with regard to image transfer, corona transfer is possible, enabling transfer with high efficiency and no toner scattering without using highly insulating transfer material such as a resin-fabricated paper or film.

Further, the separation developing method according to this invention is capable of performing development irrespective of the polarity of the electrostatic latent image, even using magnetic toner of an identical polarity.

That is, this developing process produces electric charges of the amount and polarity required for development in the portion of the toner to be developed, depending on the direction of the electric field and, particularly, overcomes the defect in the well known friction charging method where development can be attained for only a certain defined polarity.

This enables a further novel and useful developing process. Specifically, reverse development is possible by altering the direction of the electric field between the photosensitive material and the non-magnetic sleeve, for example, by merely applying a potential of a magnitude about equal to that at the non-exposed area of the latent images, to the non-magentic sleeve. This will now be explained referring to the drawings. FIGS. 3(*a*)–3(*d*) explain the principles of separation charging for reversed development, which is different from that described in FIG. 1 only in that a bias potential approximately equal to the potential at the non-exposed area of the photosensitive material is applied to the non-magnetic sleeve.

FIG. 3(*a*) shows the state before placement under the influence of the electric field formed between the photosensitive material 19 and the developing roll 17, which state is similar to that shown in FIG. 1(*a*). The magnetic toner 18 in this state has a toner layer potential insufficient for development. Differently from the case shown in FIG. 1, a bias voltage approximately equal to the potential at the non-exposed (black) area of the electrostatic latent image is applied to the developing roll 17. Then, when the magnetic toner 18 is placed under the influence of the electric field formed between the photosensitive material 19 and the developing roll 17 (FIG. 3(*b*)), electric charges with polarities opposite to those shown in FIG. 1(*b*) are produced in the magnetic toner, since a bias voltage is applied from power source 20 to the developing roll 17 and an electric field is formed in the direction opposite to that shown in FIG. 1 between the portion of the photosensitive material with no electrostatic latent charges (exposed area) and the developing roll.

When the magnetic toner in such a state contacts the photosensitive material (FIG. 3(*c*)) and the toner particles are separated, electric charges with opposite polarities are produced in the toner thus separated on the photosensitive material and on the developing roll, respectively,(FIG. 3(*d*)). The electric charges are produced between the toner particles so that an electric field $E_4$ is produced in the direction opposite the electric field $E_3$ between the photosensitive material and the developing roll, and, as a result, positive charges are produced in the toner on the photosensitive material and negative charges are produced in the toner on the developing roll. The developing roll is supplied with a bias voltage approximately equal to the potential at the non-exposed area, and the toner on the photosensitive material is deposited on the exposed area to perform reversed development.

In this way, the toner developed in the reversed manner has a polarity identical to that of the charges on the photosensitive material, and is deposited on the portion of the photosensitve material having no electrical charge or electric charge, if any, at an extremely low potential.

Figure 4:
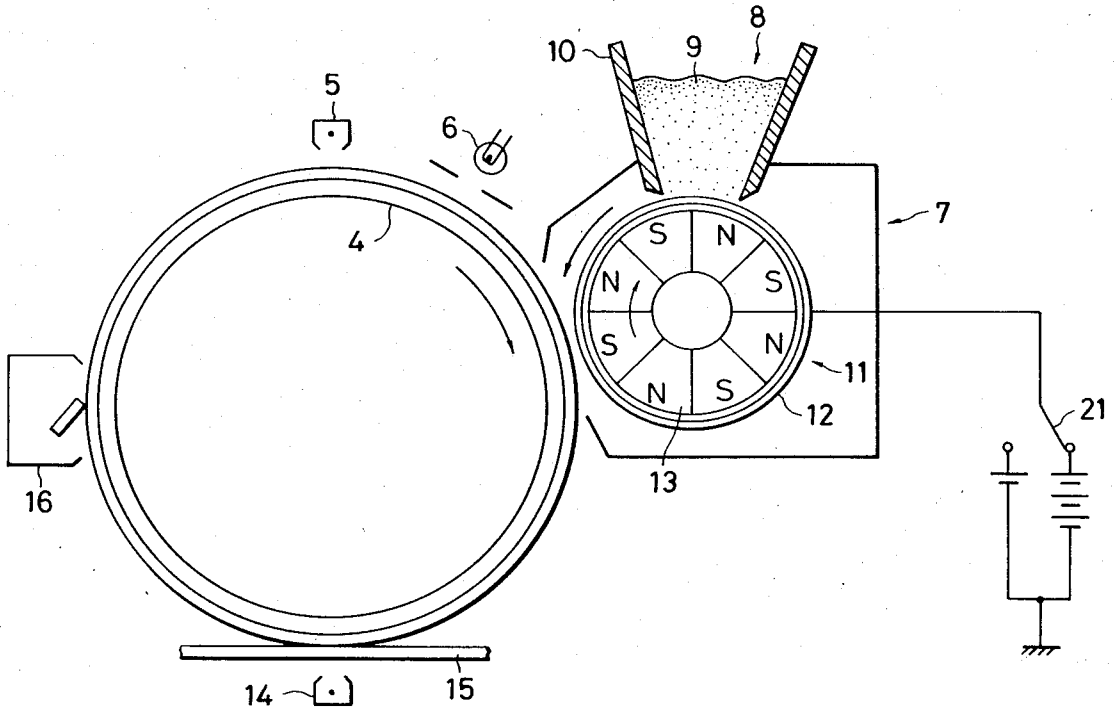
FIG. 4 is a schematic cross sectional view of one embodiment of the apparatus for use both in normal development and reversed development.

In this way, reversed development using the developing process of separation charging is made possible in the same manner as above excepting only that the bias voltage applied to the developing roll is changed. The bias voltage applied upon reversed development may be of a potential having the identical polarity and 0.1–1.2 times greater magnitude than the potential at the non-exposed area of the electrostatic latent images (the potential at the portion where the electrostatic latent image charges are present). According to such a process, it is possible to provide a reproducing machine capable of both normal reproduction and reversed reproduction as shown in FIG. 4, by merely adding a device 21 for switching the bias voltage applied to the developing roll. Further, the process can eliminate the phenomenon in the reversed developing process using frictional charging between magnetic toner particles where the toner having a large charge and easily developed is used sooner for development during the repetitive use of the magnetic toner in the developing apparatus, to result in a gradual reduction in the image density or gradation.

Figure 5:
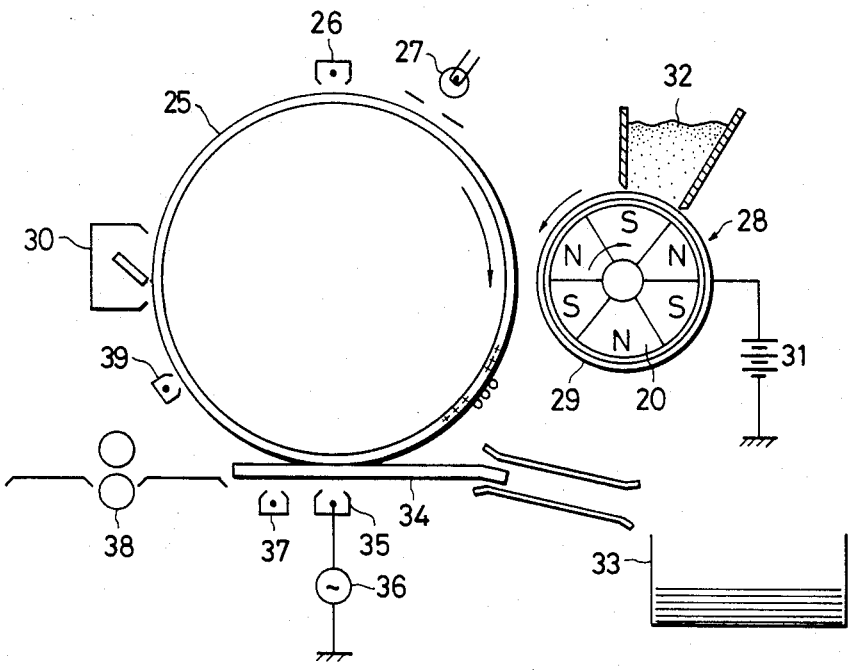
FIG. 5 is a schematic view of an example of the apparatus used in practicing the reversed transfer process according to this invention.

An embodiment of a device for transferring toner images developed in the reversed manner will now be described. FIG. 5 is a view showing one example of an apparatus for practicing the process according to this invention, in which are shown a transfer paper 34, a transfer corotron 35 and an AC power source 36 connected to the transfer corotron. A photosensitive material 25 made of Se or the like is uniformly charged by a charging corotron 26 and image-wise exposed by an exposure lamp 27 to form electrostatic latent images. A negative image original is used as an original document, and electrostatic latent images are formed including high potential portions corresponding to the charging potential at the background area (black area in the original), that is, the non-exposed area and portions with zero potential or a low potential at the letter area (the white area in the original), that is, the exposed area, respectively. The electrostatic latent images are developed in a reversed manner using the separation charging developing process as described above to obtain reversed developed toner images in which toner is deposited at the portions corresponding to the letter area of the photosensitive material. In the drawing, are shown a developing roll 28 comprising a non-magnetic sleeve 29 and internal magnets 30, a developing bias power source 31 and a magnetic toner container 32, respectively. A high bias voltage approximately equal to the potential at the non-exposed area is applied from the developing bias power source 31 to the non-magnetic sleeve 29. The toners employed herein are highly resistive magnetic toners of an electrical resistance between $10^{12}$–$10^{16}$ Ω. cm. Magnetic toners in such a range are situated in a higher resistance region of known highly resistive magnetic toners, and the electric resistance thereof can be controlled generally by the amount of magnetic material dispersed in the toner, although varying depending on the manufacturing conditions and the materials and the materials used for the toner.

The electric resistance referred to herein is determined as described above.

In the case of positively charging the photosensitive material, the toner developed in the reversed manner has positive electric charge whereby the toner is deposited in the portions at the zero or low potential of the photosensitive material but not at the high potential portions, that is, at the background area of the photosensitive material. Such toner images are transferred by the transfer process according to this invention.

The photosensitive material after the completion of development is closely contacted to a transfer paper while being maintained at the latent image potential after the completion of the development. Specifically, while the photosensitive material was priorly subjected to uniform exposure or uniform charging to eliminate the latent image potential upon transfer in prior processes, transfer is carried out while maintaining the latent image potential after the completion of the development in this invention. The transfer paper 34 sent from the transfer paper container 33 is in close contact with the photosensitive material 25 having reversed toner images and is supplied with a transferring electric field by the corotron from the back surface of the transfer paper to carry out transfer of the toner images. The transferring electric field is an AC electric field formed by the transfer corotron 35 connected to the AC power source 36.

After the end of transfer, the photosensitive material 25 and the transfer paper 34 are separated from each other by weakening the degree of close contact therebetween using a separation corotron 37, and the paper is fixed with toner images in a fixing device 38 to form the reproduction product.

On the other hand, the photosensitive material after transfer is cleansed of electrostatic latent image charges by a charge eliminating corotron 39, cleaned of residual toner by a cleaning device 30 and prepared for another reproduction cycle.

As stated above, by the transfer process according to this invention, fogging, scattering of toner images and the reduction in the transfer efficiency do not result even upon transferring reversed toner images, by using highly resistive one-component magnetic toner; and transfer at a high transfer efficiency can be carried out even when the electric resistance of the transfer paper is decreased such as in the case of highly humid conditions.

In the prior case where electric charges on the photosensitive material were eliminated by uniform exposure or uniform charging with a polarity opposite to that of the latent image potential, or with AC current, and then transfer took place by applying an intense transferring electric field of a polarity opposite to that of the latent image potential, in the same manner as in the transfer of normally developed toner images, the toner images were scattered to bring about disturbance thereof. Further, if the transfer took place by applying an intense transferring electric field of a polarity opposite to that of the latent image potential without eliminating the electric charges on the photosensitive material prior to the transfer, the toner with opposite polarity present on the photosensitive material was also transferred to result in fogging. This trend was increased, particularly, in the case where the electric resistance of the transfer paper was decreased due to highly humid conditions to produce reproduction products with remarkable fogging. In view of the above, according to this invention, no such uniform exposure or uniform charging process is applied prior to transfer for eliminating the charges on the photosensitive material, but AC corona transfer is carried out while maintaining the potential on the photosensitive material just after the end of development as it is. This prevents rapid changes in the electric field due to the elimination of the electric charges, by which no disturbance results in the toner images prior to the transfer. Further, no fogging results even when the electric resistance of the transfer paper is decreased, and transferred images at high image density can be obtained with high transfer efficiency.

In the transfer process according to this invention, particularly preferred results are obtained in the case of using magnetic toners easily effecting charge exchange.

If charge exchange occurs between the magnetic toner particles, between the magnetic toner and the transfer material or between the magnetic toner and the photosensitive material, remarkable fogging and scattering of toner typically results but such phenomena are not caused using the transfer process according to this invention. Magnetic toners easily effecting charge exchange are those magnetic toners having electroconductive portions on the surface thereof, for example, magnetic toners having magnetic material partially exposed on the surface or magnetic toners having fine conductive particles such as carbon black deposited on the surface.

Figure 6:
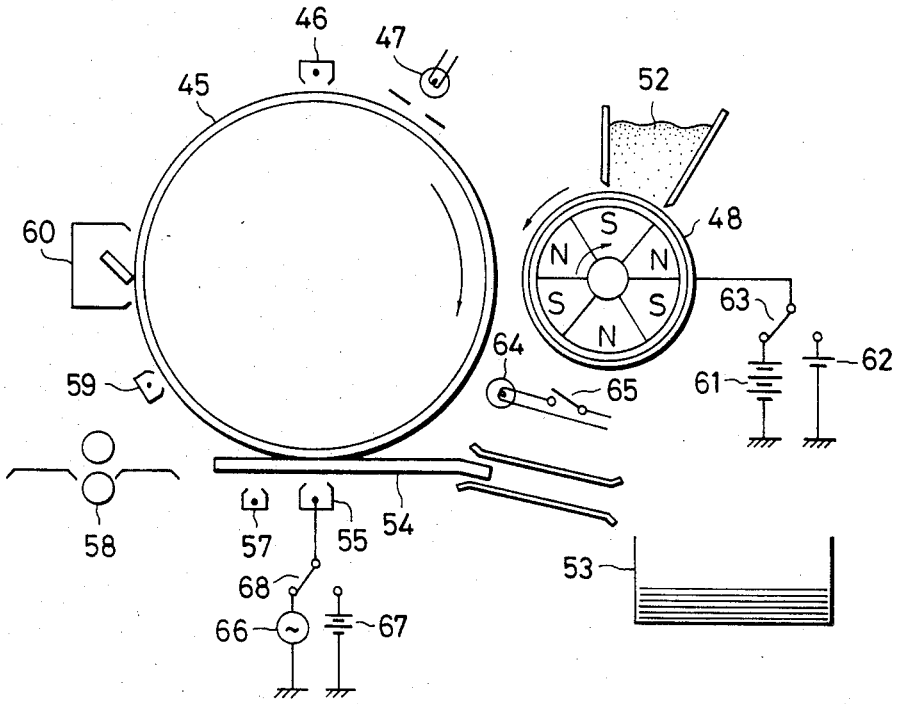
FIG. 6 is a schematic view of another example of a reproducing apparatus capable of both normal reproduction and reversed reproduction, also employed in practicing the transfer process according to this invention.

By utilizing the transfer process according to this invention, a copying machine capable of both normal reproduction and reversed reproduction can easily be manufactured. FIG. 6 shows a second example of a reproducing apparatus for use in both normal reproduction and reversed reproduction, which is different from the embodiment shown in FIG. 5 by the provision of a developing bias power source 61 for reversed development, a developing bias power source 62 for normal development, a developing bias changeover switch 63, a uniform exposure lamp 64, an ON-OFF switch 65 for the exposure lamp, a transfer power source 66 for reversed reproduction, a transfer power source 67 for normal reproduction and a changeover switch 68 for the transfer power sources. FIG. 6 shows the state of carrying out reversed reproduction, in which the developing roll 48 is connected to the developing bias power source 61 for reversed development which applies a voltage approximately equal to the potential at the non-exposed area of the photosensitive material, the uniform exposure map 64 for eliminmating the latent image charges on the photosensitive material prior to the transfer is set to an unactuated state and the transfer corotron 55 is connected to the transferring power source 66 for AC reversing reproduction. The reversed reproduction takes place under a state such as described above. In the case of normal reproduction, switches 63, 65, and 68 are turned so as to establish connections opposite to that shown.

Specifically, the developing roll is connected to the developing bias power source 62 for normal development, approximately equal to the potential at the exposed area of the photosensitive material, the uniform exposure lamp 64 is set to an actuated state and the transfer corotron is connected to a DC transfer power source for normal reproduction at the same polarity as the latent image potential. In such a state, the images are transferred on the transfer paper by a DC corona with a polarity identical with that of the latent images, that is, opposite to that of the toner. In this way, a reproducing machine capable of both normal and reversed reproduction utilizing the transfer process according to this invention can be selectively operated by the simple operation of switching connections.

As stated specifically above, the one-component magnetic brush developing process using separation charging according to this invention is a novel developing process enabling development with high image density, less fogging and excellent gradation and resolution power. The process further enables both normal and reversed development by merely changing the bias voltage applied to the developing roll and, with regard to transfer, enables transfer at high efficiency and with no toner scattering.

What is claimed is:

1. An electrostatic latent image developing process, comprising providing a developing roll composed of a non-magentic sleeve with a conductive surface and magnets disposed therein, at least sleeve being made rotatable, forming a magnetic brush with magnetic toner particles of an electrical resistance between $10^{12}$–$10^{16}$ Ω. cm on said developing roll, maintaining a first electric field between the developing roll and an electrostatic latent image carrier, such that the developing potential at the background area of the electrostatic latent image on the latent image carrier prior to development is insufficient to charge the magnetic toner of the magnetic brush to effect developing, causing magnetic toner particles at the tip of said magnetic brush to contact the carrier of said latent electrostatic image and thereby cause the magnetic toner particles at the tip of the magnetic brush to separate from the magnetic brush in the first electric field formed between the electrostatic latent image and the developing roll, to thereby produce electric charges on the separated magnetic toner particles and the magnetic toner particles remaining on the tip of the magnetic brush to form a second electric field opposite to said first electric field, said charges having opposite polarities with respect to the toner thus separated on the electrostatic latent image side and the developing roll side, respectively, and developing said electrostatic latent images using the toner having the electric charges thus produced.

2. A process as claimed in claim 1, wherein said electric resistance is measured by placing a toner block of 3 mm thickness, compression molded at a pressure of 500 kg/cm$^2$ between electrode plates under an applied electric field of 8 kV/cm$^2$.

3. A process as claimed in claim 2, wherein said magnets and said magnetic sleeve are each rotatable, and in opposite directions.

4. A process as claimed in claim 1, wherein said carrier and said sleeve are disposed such that the clearance therebetween is 0.1 to 1.0 mm.

5. A process as claimed in claim 4, wherein said clearance is between 0.2 and 0.7 mm.

6. A process as claimed in claim 4, further comprising setting a ratio of the distance between a magnetic brush control plate and said developing roll, and said clearance to a value between 0.4 and 0.8.

7. A process as claimed in claim 6, further comprising eliminating excessive charge on said toner before development whereby said toner is given a potential insufficient for development.

8. A process as claimed in claim 7, said magnetic brush control plate being used to eliminate said excessive charge.

9. A process as claimed in claim 1, wherein said separation of said magnetic brush is effected midway of the toner particle chain constituting said magnetic brush.

10. A process as claimed in claim 1, further comprising setting the surface movement speed of said magnetic brush to a value at least three times the surface moving speed of said carrier.

11. A process as claimed in claim 1, said magnetic toner comprising toner particles having surface electroconductive portions.

12. A process as claimed in claim 1, further comprising transferring toner images from said carrier to a transfer medium by corotron transfer.

13. An electrostatic latent image reverse developing process, comprising providing a developing roll composed of a non-magnetic sleeve with a conductive surface and magnets disposed therein, at least said sleeve being made rotatable, applying a bias voltage approximately equal to the potential of electrostatic latent images formed on a carrier to said sleeve, forming a magnetic brush with magnetic toner particles of an electrical resistance between $10^{12}$–$10^{16}$ Ω. cm on said developing roll, maintaining a first electric field between the developing roll and an electrostatic latent image carrier, such that the developing potential at the background area prior to the development is insufficient to charge the magnetic toner particles of the magnetic brush to effect developing, causing magnetic toner particles at the tip of said magnetic brush to separate from the magnetic brush in the first electric field formed between the electrostatic latent image and the developing roll to thereby produce electric charges on the separated magnetic toner particles and the magnetic toner particles remaining on the tip of the magnetic brush to form a second electric field opposite to said first electric field, said charges having opposite polarities with respect to the toner separated on the electrostatic latent image side and on the developing roll side, respectively, and developing said electrostatic latent images using the toner having the electric charges thus produced.

14. A process as claimed in claim 13, wherein said electric resistance is measured by placing a toner block of 3 mm thickness, compression molded at a pressure of 500 kg/cm$^2$ between electrode plates under an applied electric field of 8 kV/cm$^2$.

15. A process as claimed in claim 13, wherein said carrier and said sleeve are disposed such that the clearance therebetween is 0.1 to 1.0 mm.

16. A process as claimed in claim 15, wherein said clearance is between 0.2 mm and 0.7 mm.

17. A process as claimed in claim 15, further comprising setting a ratio of the distance between a magnetic brush control plate and said developing roll, and said clearance to a value between 0.4 and 0.8.

18. A process as claimed in claim 13, wherein said separation of said magnetic brush is effected midway of the toner particle chain constituting said magnetic brush.

19. A process as claimed in claim 13, further comprising transferring toner images from said carrier to a transfer medium by corotron transfer.

20. A process as claimed in claim 19, wherein said corotron transfer process comprises supplying corona discharges from the back side of said transfer medium.

21. An electrostatic latent image developing process, comprising providing a developing roll composed of a non-magnetic sleeve with a conductive surface and magnets disposed therein, at least said sleeve being made rotatable, forming a magnetic brush with a magnetic toner of an electrical resistance between $10_{12}$–$10^{16}$ Ω. cm on said developing roll, maintaining the developing potential at the background area prior to development lower than the potential upon the start of development, causing magnetic toner particles of said magnetic brush to separate from one another in an electric field formed between the electrostatic latent image and the developing roll while contacting said magnetic brush and a carrier of said electrostatic latent images as the magnetic brush moves past the carrier at a surface movement speed at least three times the surface moving speed of said carrier, to thereby produce electric charges forming a second electric field opposite to said electric field, said charges having opposite polarities with respect to the toner thus separated on the electrostatic latent imate side and the developing roll side, respectively, and developing said electrostatic latent images using the toner having the electric charges thus produced.

* * * * *